US008287020B1

(12) United States Patent
Guerin

(10) Patent No.: US 8,287,020 B1
(45) Date of Patent: Oct. 16, 2012

(54) ROLL CONTAINER

(76) Inventor: Phillip M. Guerin, Lawrence, MA (US)

( * ) Notice: Subject to any disclaimer, the term of this patent is extended or adjusted under 35 U.S.C. 154(b) by 0 days.

(21) Appl. No.: 13/252,308

(22) Filed: Oct. 4, 2011

Related U.S. Application Data

(63) Continuation-in-part of application No. 13/181,615, filed on Jul. 13, 2011.

(51) Int. Cl.
*A45F 5/10* (2006.01)

(52) U.S. Cl. ..... 294/148; 294/156

(58) Field of Classification Search ..... 294/16, 294/31.2, 27.1, 137, 119.2, 148, 156, 157; D6/518; D8/396; 206/395, 397, 409; 211/26, 211/30, 45

See application file for complete search history.

(56) References Cited

U.S. PATENT DOCUMENTS

| | | | | | |
|---|---|---|---|---|---|
| 404,596 | A | | 6/1889 | Caldwell | |
| 1,168,703 | A | | 1/1916 | Bauer | |
| 2,031,033 | A | | 2/1936 | Denebeim | |
| 3,166,187 | A | | 1/1965 | Araujo | |
| 3,337,044 | A | | 8/1967 | Smith et al. | |
| 3,796,305 | A | | 3/1974 | Beason | |
| 3,856,141 | A | | 12/1974 | Reed | |
| 3,921,872 | A | * | 11/1975 | Buell, Jr. | 206/446 |
| 3,982,712 | A | | 9/1976 | Bassett | |
| 3,998,326 | A | | 12/1976 | McKee, Jr. | |
| 4,034,926 | A | | 7/1977 | Wegner | |
| 4,239,164 | A | | 12/1980 | Barnsbee et al. | |
| 4,274,573 | A | | 6/1981 | Finkelstein | |
| 4,310,110 | A | * | 1/1982 | Dexter | 224/246 |
| 4,470,177 | A | * | 9/1984 | Ganung et al. | 24/270 |
| 4,754,996 | A | * | 7/1988 | Tecca et al. | 294/151 |
| 4,805,794 | A | | 2/1989 | Tsuchiya et al. | |
| 4,821,876 | A | | 4/1989 | Naito et al. | |
| 4,826,015 | A | | 5/1989 | Mandel | |
| 4,901,855 | A | | 2/1990 | Furukawa | |
| 4,957,246 | A | | 9/1990 | Kantor | |
| D313,752 | S | | 1/1991 | Dyble | |
| D316,789 | S | * | 5/1991 | McLaughlin | D6/522 |
| 5,038,934 | A | | 8/1991 | Higashiyama | |
| 5,284,247 | A | | 2/1994 | Turner | |
| D383,934 | S | * | 9/1997 | McNaughton | D6/518 |
| D394,572 | S | * | 5/1998 | Devaney | D6/518 |
| 5,819,935 | A | | 10/1998 | Lawson | |
| 5,867,969 | A | | 2/1999 | Quinones | |
| D419,015 | S | * | 1/2000 | Umemoto | D6/522 |
| 6,446,808 | B1 | | 9/2002 | Paul et al. | |
| 6,530,473 | B1 | | 3/2003 | St. Felix | |
| 7,306,100 | B1 | | 12/2007 | Eslambolchi et al. | |
| D576,433 | S | | 9/2008 | Che | |
| D585,514 | S | * | 1/2009 | Cresswell | D21/804 |
| D613,982 | S | | 4/2010 | Wilson et al. | |
| 8,056,947 | B2 | * | 11/2011 | Davidson | 294/16 |
| D653,887 | S | * | 2/2012 | Guerin | D6/518 |
| 2004/0004013 | A1 | | 1/2004 | Dieter et al. | |
| 2011/0240669 | A1 | * | 10/2011 | Festa | 221/45 |

* cited by examiner

*Primary Examiner* — Paul T Chin
(74) *Attorney, Agent, or Firm* — David M. Driscoll, Esq.

(57) ABSTRACT

A container for a roll of sheet metal material that includes a partially circular base and oppositely disposed end walls that are integrally formed with the base and that define with the base an open channel in which the roll of material is to be placed. An elongated slot is provided along the base and dimensioned so as to receive an end of the roll of sheet material for dispensing through the slot. An elastic cord is attached at opposite sides of the base and extend about the roll of material for holding the roll of material in the open channel. A set of clips are engageable with the base for accommodating smaller length rolls.

20 Claims, 11 Drawing Sheets

ROLL CONTAINER

RELATED APPLICATIONS

This application is a continuation-in-part of application Ser. No. 13/181,615 filled on Jul. 13, 2011 and which is incorporated by reference herein in its entirety.

FIELD OF THE INVENTION

The present invention relates to containers, and pertains more particularly to an improved container construction that is particularly suited for supporting and dispensing roll material. Even more particularly the present invention relates to a container for supporting and dispensing a sheet metal roll.

BACKGROUND OF THE INVENTION

Sheet metal rolls are widely used in the construction business for a wide variety of applications including in the roofing field. These rolls are typically used, as is, with the result that the unused roll is found around the construction site in an unorganized manner. This also creates an unsafe situation in which sharp edges of the roll are exposed.

Accordingly, it is an object of the present invention to provide a dispensing container for a roll of sheet material, particularly metal sheet material.

Another object of the present invention is to provide a container for supporting and dispensing a sheet metal roll, and which is simple in construction, easy to use and can be made relatively inexpensively.

A further object of the present invention is to provide a roll container in which a particular method is used for the use of the container that allows ready insertion of the roll into the container, as well as ready dispensing of the sheet material from the roll.

SUMMARY OF THE INVENTION

To accomplish the foregoing and other objects of the present invention there is provided a container for a roll of material that includes a partially circular base and oppositely disposed end walls that are integrally formed with the base and that define with the base an open channel in which the roll of material is to be placed; an elongated slot provided along said base and dimensioned so as to receive therethrough an end of the roll of sheet material for dispensing thereof; and an elongated elastic cord attached at opposite sides of the base and extending about the roll of material for holding the roll of material in the open channel.

In accordance with other aspects of the present invention the elongated slot extends from one end wall to the opposite end wall; the elongated slot divides the base into semi-circular first and second base segments; including a first cord holder attached to the first base segment for retaining the elongated elastic cord; including a second cord holder attached to the second base segment for releasably holding the elongated elastic cord; including a pair of second cord holders that are spacedly disposed; each second cord holder has a projection that extends radially from the second base segment, and each projection has on one side thereof a lip for receiving the elastic cord; the second cord holder comprises a projection that extends radially from the second base segment; the projection has on one side thereof a lip for receiving the elastic cord; the projection has on another side thereof an indentation that forms a carry handle; the first cord holder has a through passage for receiving ends of the elongated elastic cord so as to retain the ends in place; including a pair of first holder that are spacedly disposed and that each have a through passage; the projection has on another side thereof an indentation that forms a carry handle; the first cord holder has a through passage for receiving ends of the elongated elastic cord so as to retain the ends in place; the elongated elastic cord has a free end that is looped over the projection and retained by the projection lip Also in accordance with the present invention there is provided a method of supporting and dispensing sheet metal from a roll that is disposed in a container for the roll, comprising the steps of: providing a partially circular base and oppositely disposed end walls that are integrally formed with the base and that define with the base an open channel and having an elongated slot provided along said base; placing said roll into said base with the slot constructed and arranged so as to receive therethrough an end of the roll of sheet material for dispensing thereof; and having an elongated elastic cord attached at opposite sides of the base and extending about the roll of material for holding the roll of material in the open channel.

Other aspects of the method of the present invention include the elongated slot divides the base into semi-circular first and second base segments, and attaching the cord a first cord holder for retaining the elongated elastic cord; including a second cord holder attached to the second base segment for releasably holding the elongated elastic cord; the second cord holder comprises a projection that extends radially from the second base segment; the projection has on one side thereof a lip for receiving the elastic cord; and the projection has on another side thereof an indentation that forms a carry handle.

In accordance with another aspect of the present invention, there is provided at least one spacer clip that can be used for engagement with the base. When engaged on the inside surface of the base, the spacer clip provides for the support of a smaller length roll. Preferably a pair of spacer clips that are spacedly disposed along the base member are used for supporting the smaller diameter roll. Each spacer clip is comprised of an integral elastic member having a central concave area and opposed legs terminating in respective edge engagement loops.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

Reference is now made to the drawings and the first embodiment of the present invention illustrated in FIGS. 1-6. The container is comprised primarily of a partially circular base 10 and oppositely disposed end walls 12 and 14. The oppositely disposed end walls 12, 14 are preferably integrally formed with the base 10 and define with the base 10 an open channel 18 in which the roll 20 is secured.

Figure 1:
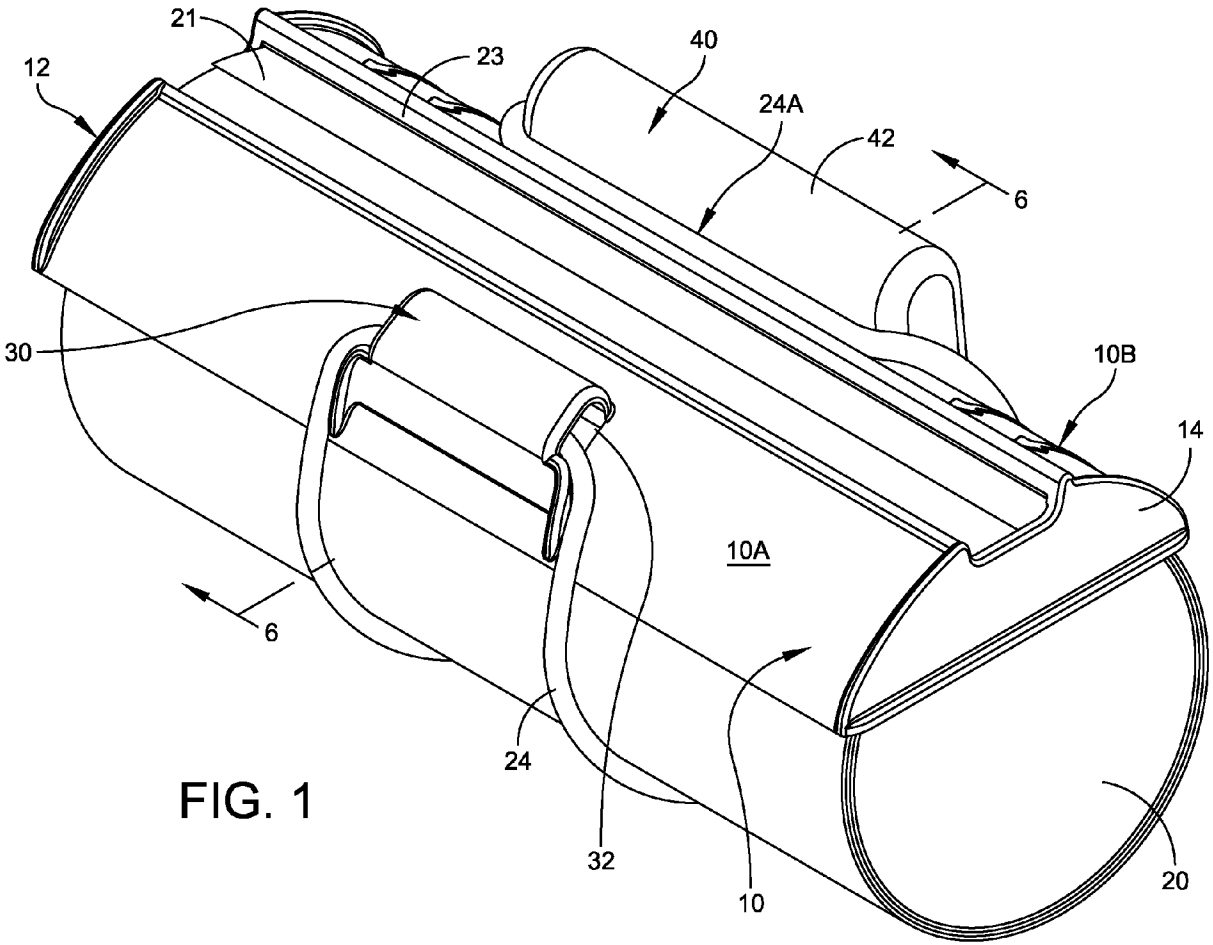
FIG. 1 is a perspective view of the roll container with a roll of metal material disposed therein.

An elongated and substantially centrally disposed slot 22 is provided. The slot 22 preferably extends from one end wall 12 to the oppositely disposed end wall 14. In FIG. 1, because the roll 20 is in place, an edge 21 of the roll is depicted as extending through the slot 22. An elongated elastic cord 24 is attached at opposite sides of the base and extends about the roll of material for holding the roll of material securely in the open channel 18.

The elongated slot 22 may have a width on the order of one inch and the base may have a length any where from 10 to 20 inches. An edge 23 at the slot 22 forms a guide for cutting a desired length of the sheet metal roll. The slot 22 essentially divides the base into semicircular first and second base segments 10A and 10B. Preferably on the segment 10B, there are provided directional arrows 11 that can be used to illustrate the direction that the roll is to be placed in the base.

Figure 2:
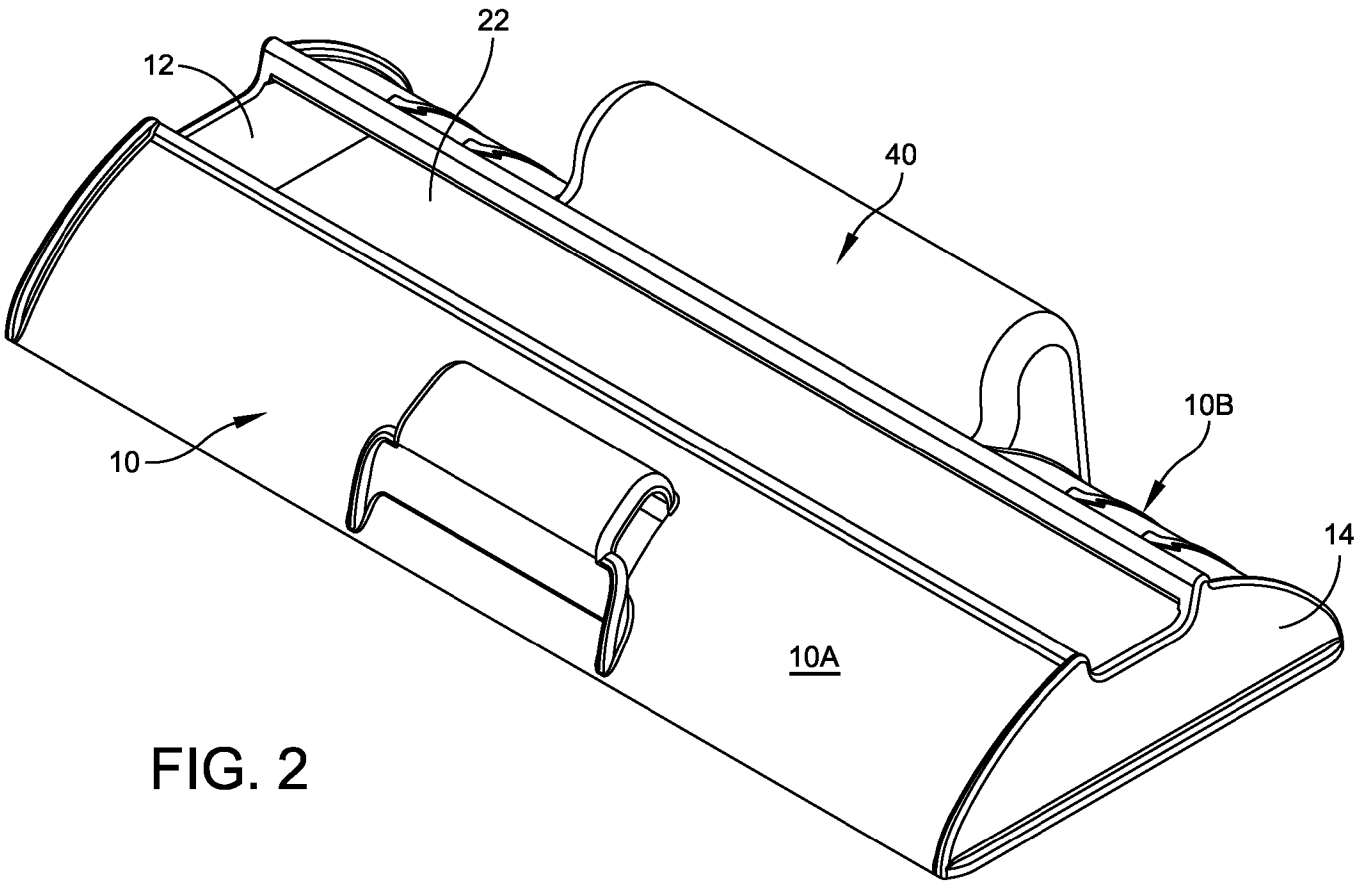
FIG. 2 is a perspective view of the roll container without the metal roll.
Figure 3:
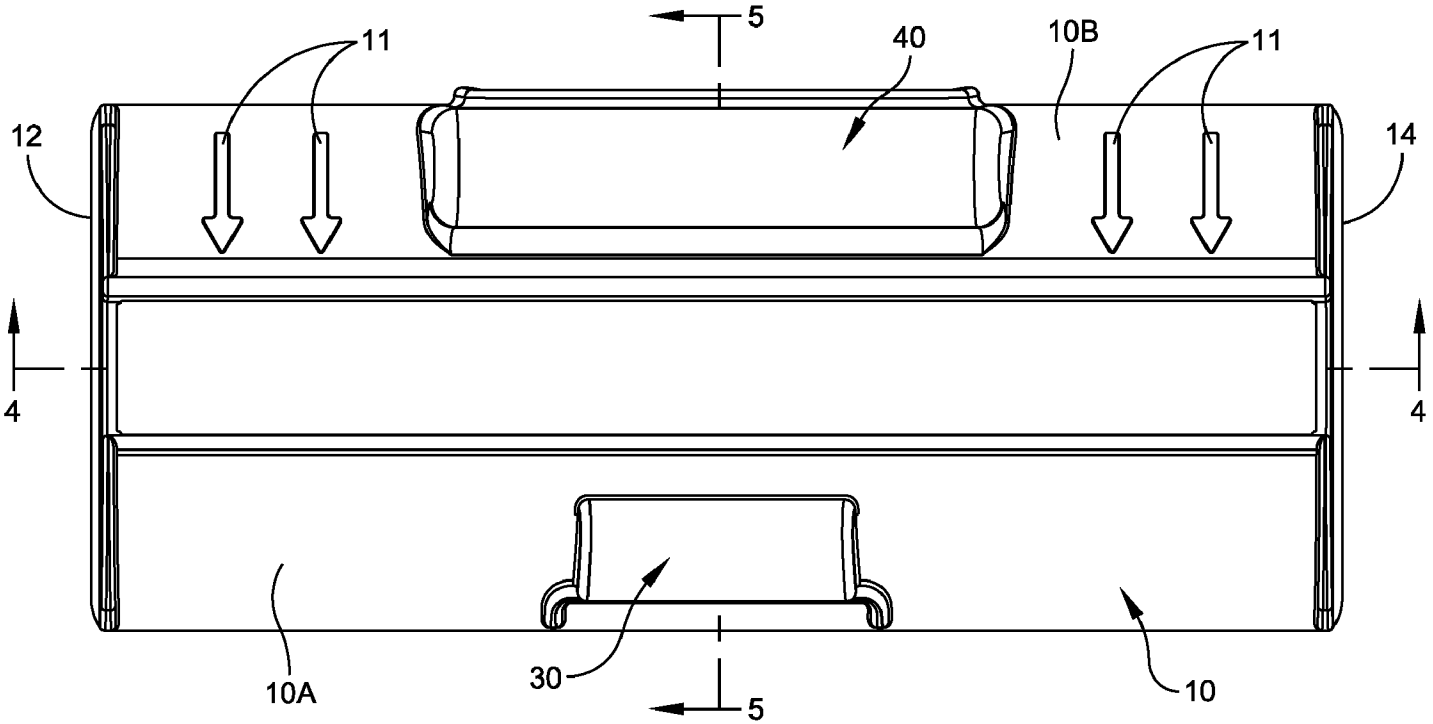
FIG. 3 is a plan view of the roll container.
Figure 4:
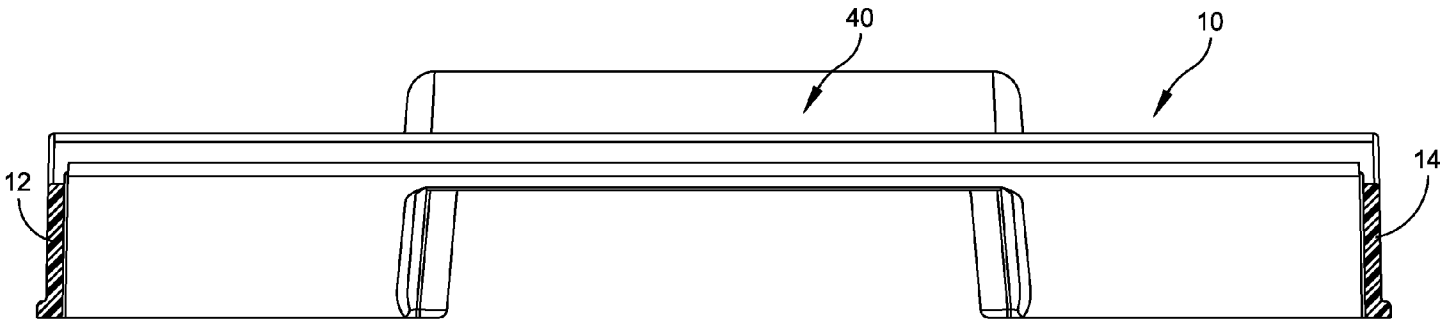
FIG. 4 is a cross-sectional view taken along line 4-4 of FIG. 3.

The cord 24 is an elastic cord and, as illustrated in FIGS. 1 and 2, ends of the elastic cord may be supported in a first cord holder 30. The holder 30 is defined by a protruding cap with a through passage 32. Respective ends of the cord may be tied together within the passage 32. The cord 24 is preferably fixedly secured to this first holder 30. The first holder 30 is secured to or integrally formed with the first base segment 10A. The entire base, along with the associated holders are preferably constructed by a single molding process. Refer to the cross-sectional view of FIG. 5 that shows the cross-section of the holder 30 and also refer to the cross-sectional view of FIG. 6 which depicts the elastic cord 24 captured within the passage 32 of the holder 30.

There is also provided a second cord holder 40 attached to the second base segment 10B and integrally formed therewith. The second cord holder is for releasably holding the elongated elastic cord 24. Refer to FIG. 1 that shows the cord 24 wrapped about the metal roll 20 and engaged at 24A with the holder 40. Refer also to the cross-sectional views of FIGS. 5 and 6 for the cross-sectional configuration of the holder 40. FIG. 6 also illustrates the cord segment 24A captured by the holder 40.

This second holder 40 is comprised primarily of a projection 42 that extends somewhat radially from the second base segment. The projection 42 has on one side thereof an indentation lip 44 for receiving the elastic cord 24. Once again, FIG. 1 depicts the elastic cord in place captured by the second holder 40 with that segment of the electric cord engaged behind the lip of the holder 40.

Figure 5:
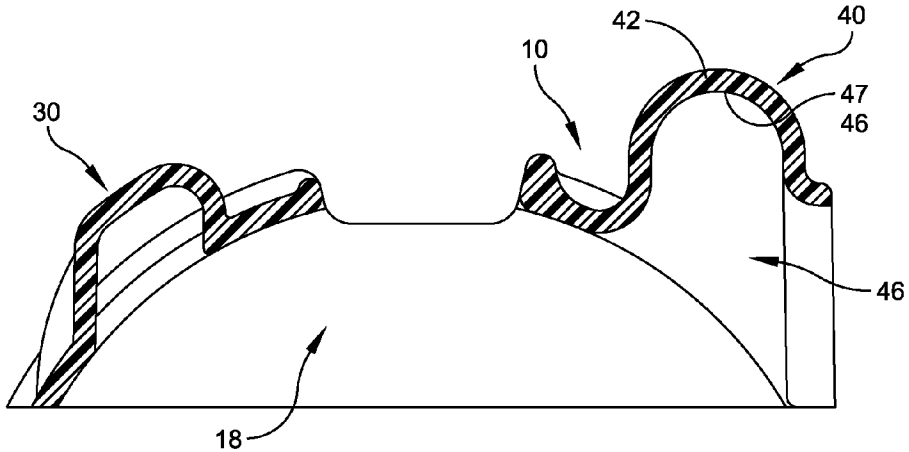
FIG. 5 is a cross-sectional view taken along line 5-5 of FIG. 3.
Figure 6:
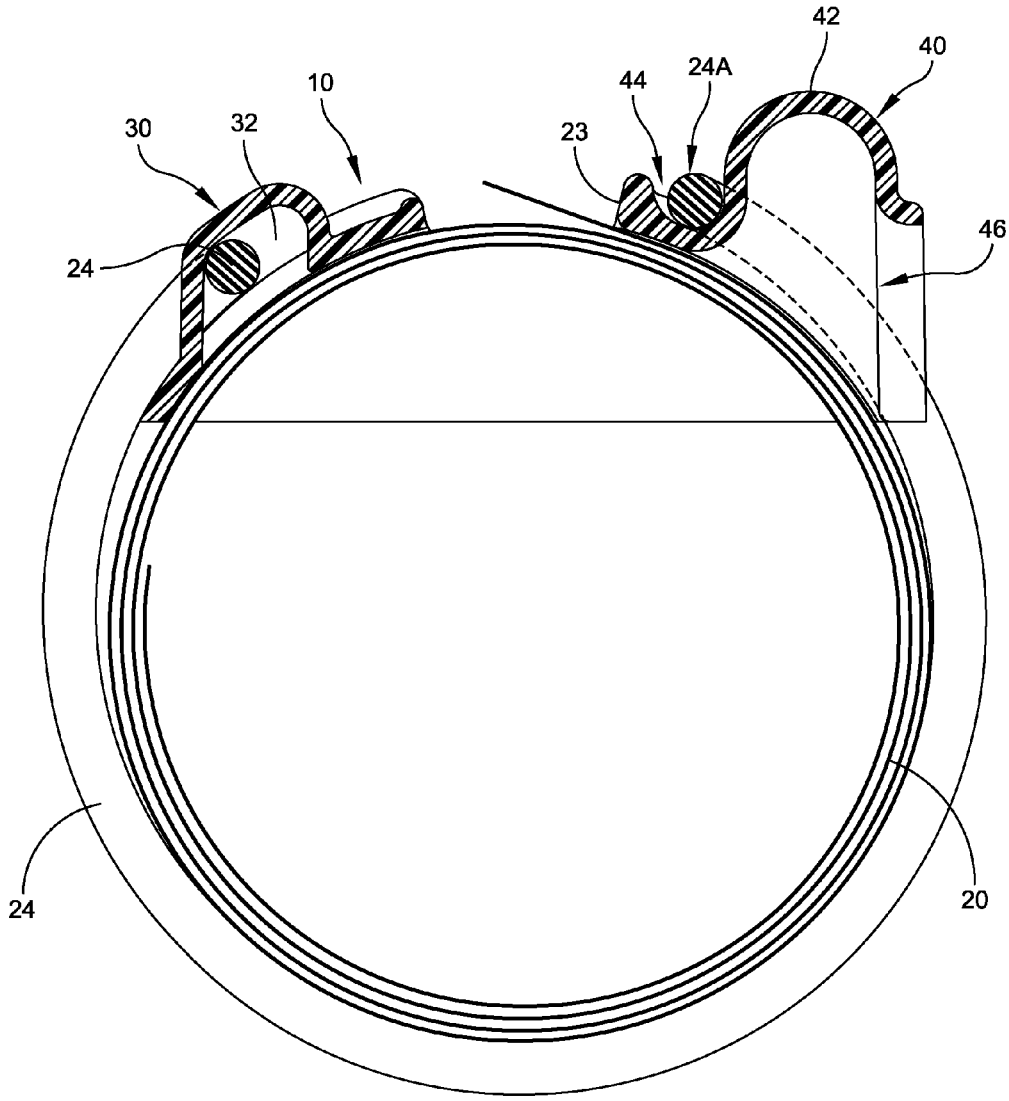
FIG. 6 is a cross-sectional view taken along line 6-6 of FIG. 1.

Another feature associated with the holder 40 is that along a substantial length thereof, it is provided with an opening 46 as shown in FIGS. 5 and 6. In this way the holder 40 can function as a handle for lifting the base as well as the supported sheet metal roll. The opening or indentation 46 may have a height of about one inch and may have a length of 4-6 inches. The inner surface 47 of the holder functions as a location for the user's fingers.

Figure 7:
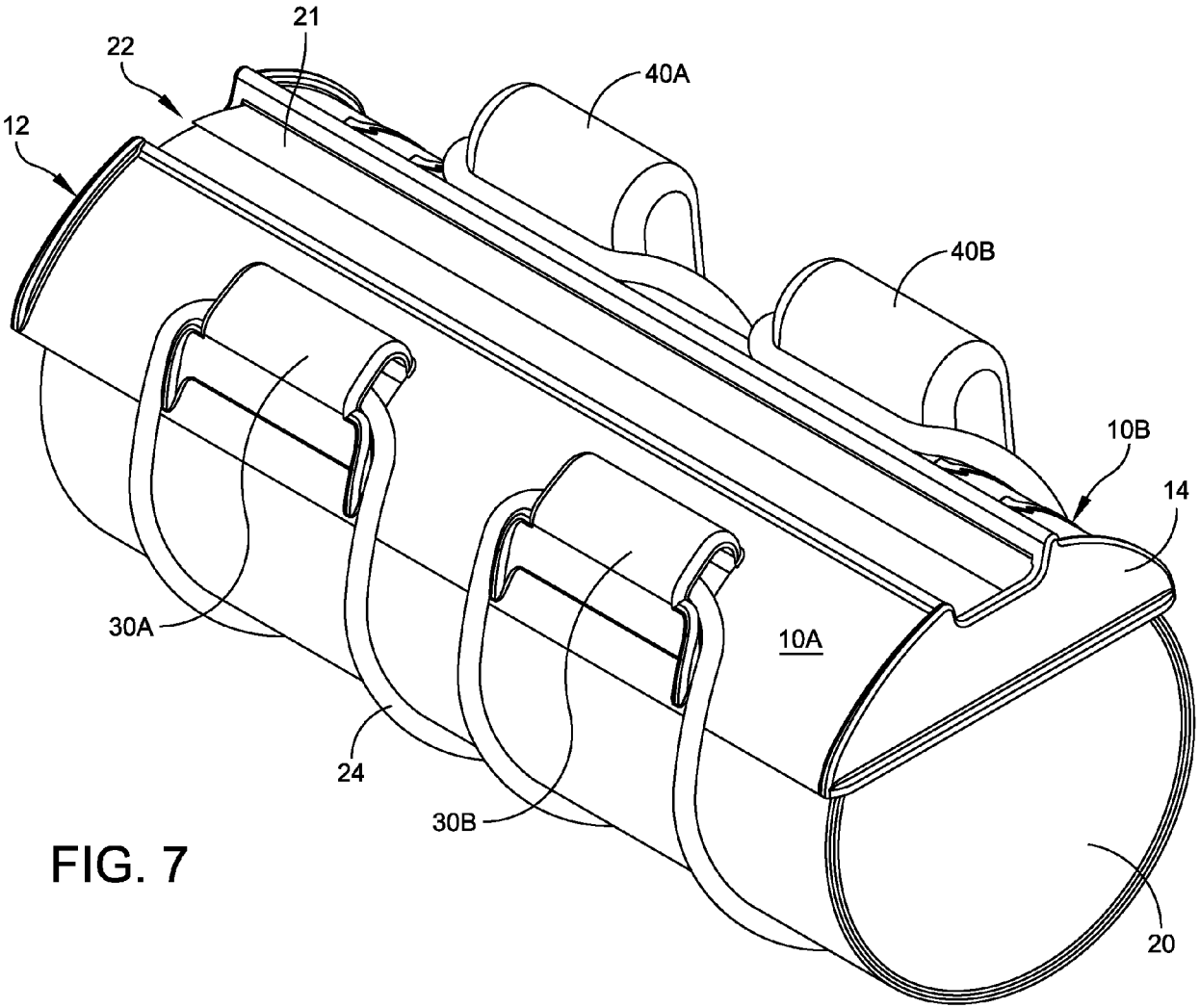
FIG. 7 is a perspective view similar to that shown in FIG. 1 but for an alternate embodiment of the invention.

Reference is now made to an alternate embodiment of the present invention illustrated in the perspective view of FIG. 7. In FIG. 7 some of the same reference characters are used as previously identified in FIG. 1. The embodiment of FIG. 7 employs a pair of first holders 30A and 30B. Respective ends of separate elastic cords may be secured in these holders 30A and 30B or the elastic cord may extend between the holders 30A and 30B. On the other base segment 10B are provided a pair of second holders 40A and 40B. Both the holders 30A and 30B, as well as the holders 40A and 40B, are preferably spacedly disposed along the surface of their respective base segments. As in the first embodiment in FIG. 1, the elastic cord 24 is shown being captured by both of the second holders. In still another embodiment, the holder pairs 30A and 30B; 40A and 40B may be provided with a single elastic cord. In that case the ends of the elastic cord are respectively secured to holders 30A, 30B. In a further embodiment a pair of holders 30A, 30B may be used with a single holder 40 (as in FIG. 1).

Figure 12A:
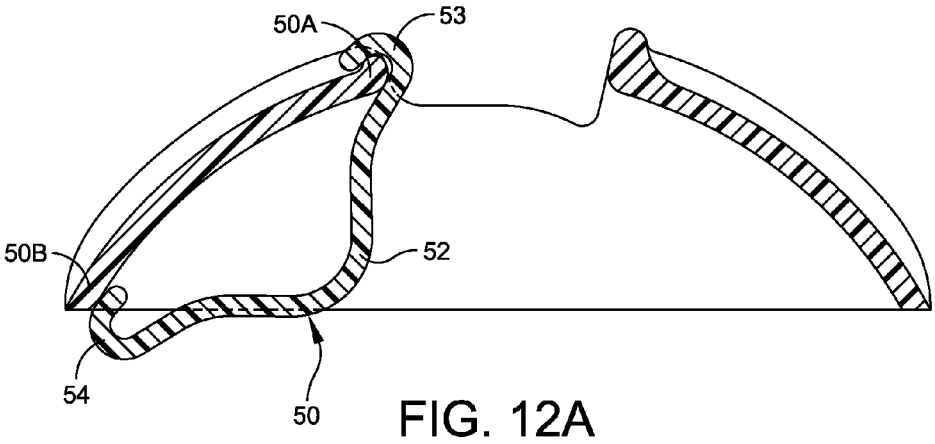
FIG. 12A is a cross-sectional view similar to that described in FIGS. 11A and 11B but illustrating the spacer clip in a molded condition on the inner side of the base.
Figure 12B:
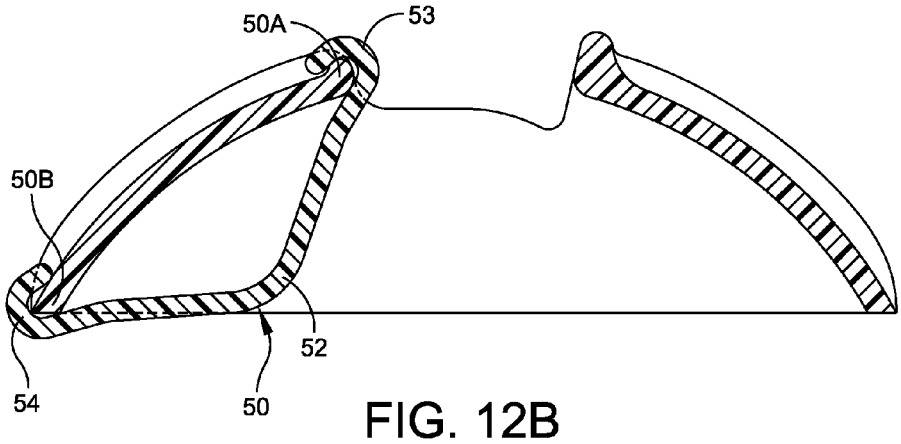
FIG. 12B is a cross-sectional view similar to that illustrated in FIG. 12A but showing the spacer clip in a stretched condition.

Another aspect of the present invention involves the use of spacer clips 50 that can be applied inside of the base, such as illustrated in FIGS. 12A and 12B for essentially reducing the inside volume (length). These are used to accommodate metal rolls of smaller length such as the smaller roll 20 illustrated in dotted outline in FIG. 9. The spacer clips 50 are spring-like, are provided usually in a pair, and can be attached on the outside of the base when not in use or alternatively clipped on the inside of the base to accommodate smaller length metal rolls.

Figure 8:
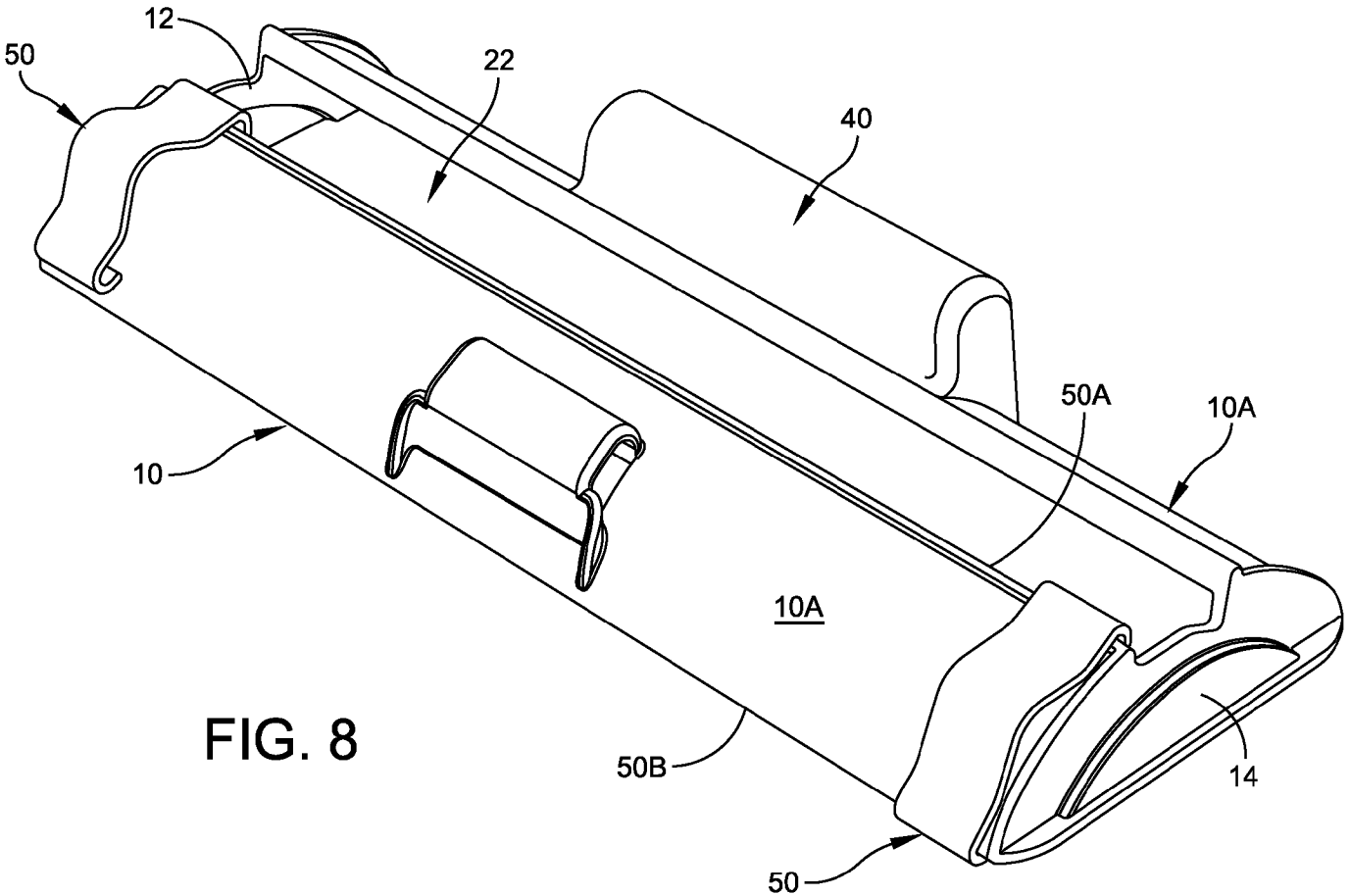
FIG. 8 is a perspective view of the roll container without the metal roll but further including a set of spacer clips.
Figure 9:
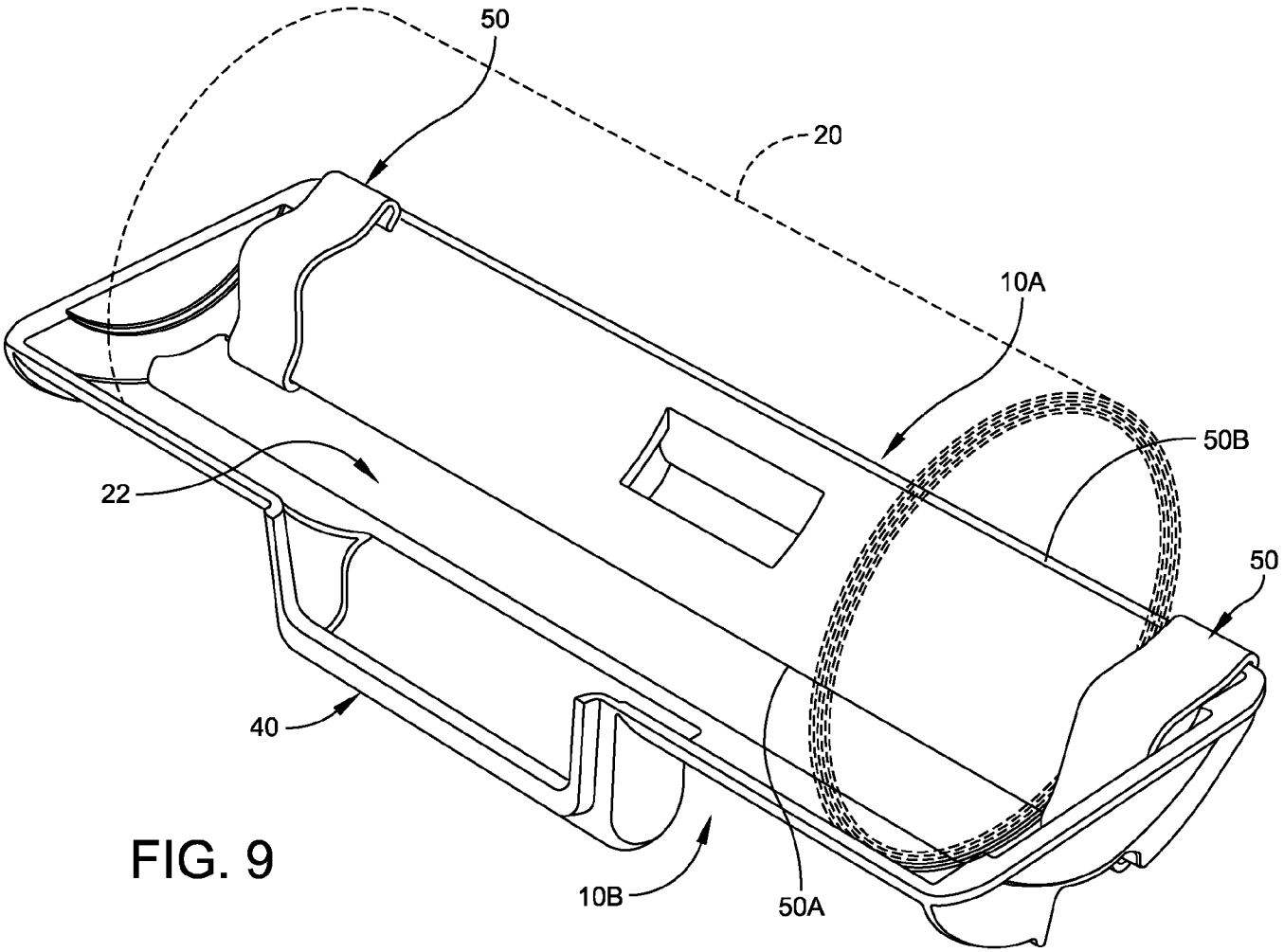
FIG. 9 is an inner perspective view of the roll container showing the set of spacer clips in place and a shorter length roll in dotted outline.

Now, with regard to this spacer clip 50, reference is made to FIGS. 8-12 herein. FIG. 8 is a perspective view of the roll container without the metal roll but further including a set of spacer clips 50. FIG. 9 is an inner perspective view of the roll container showing the set of spacer clips in place, and the roll 20 in place between the clips, shown in dotted outline. FIG. 10A is a side elevation view of one of the spacer clips. FIG. 10B is a bottom plan view of the spacer clip of FIG. 10A. FIG. 11A is a cross-sectional view like that illustrated in FIG. 5 showing one of the spacer clips in its normal molded condition on the outside of the base 10. FIG. 11B is a cross-sectional view like that shown in FIG. 11A but illustrating the spacer clip in a stretched condition on the outside of the base. FIG. 12A is a cross-sectional view similar to that described in FIGS. 11A and 11B but illustrating the spacer clip in a molded condition on the inner side of the base. FIG. 12B is a cross-sectional view similar to that illustrated in FIG. 12A but showing the spacer clip in a stretched condition.

Figure 11A:
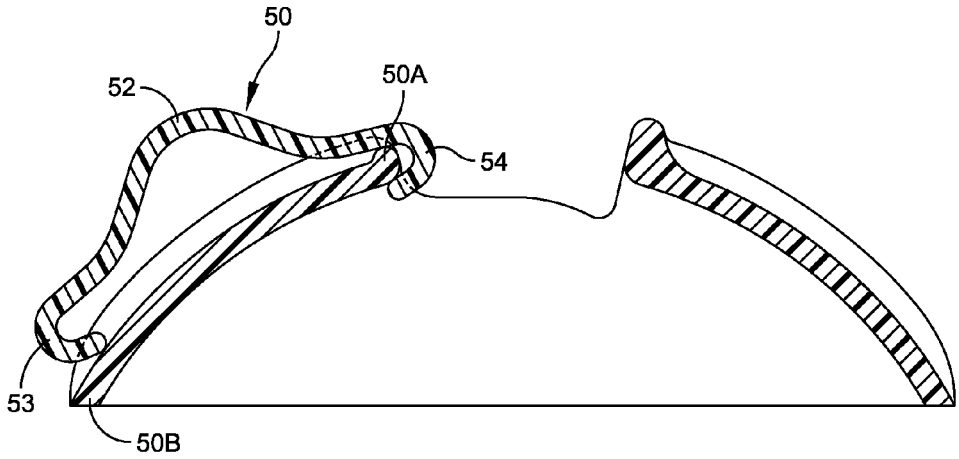
FIG. 11A is a cross-sectional view like that illustrated in FIG. 5 showing one of the spacer clips in its normal molded condition on the outside of the base 10.
Figure 11B:
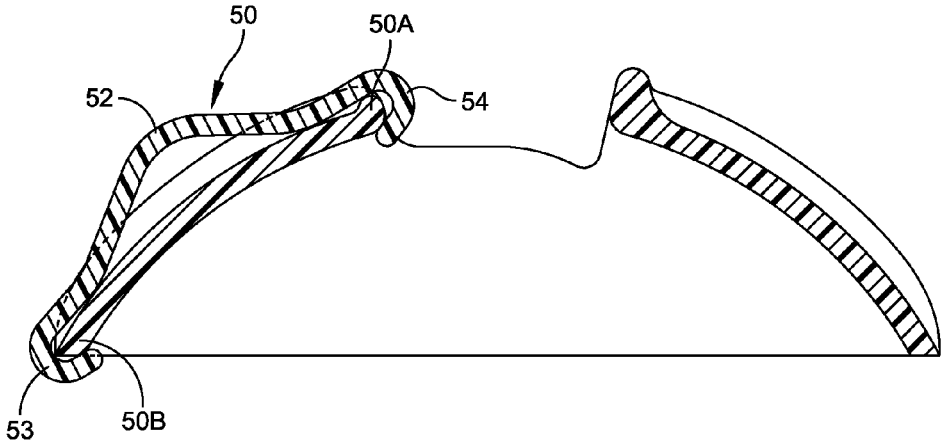
FIG. 11B is a cross-sectional view like that shown in FIG. 11A but illustrating the spacer clip in a stretched condition on the outside of the base.

FIGS. 8, 11A and 11B illustrate one of the positions of the spacer clip 50 when the spacer clip 50 is supported between edges 50A and 50B from the base 10. In FIGS. 8, 11A and 11B, the spacer clip is disposed on the outer surface of the base. In that position, the set of clips are basically in a storage position out of use. In this regard, FIG. 11A shows the spacer clip 50 in its original unflexed condition. FIG. 11B shows the spacer clip stretched so as to engage the edges 50A and 50B. The edge 50A defines one side of the slot 22 and edge 50B is the linear edge along the bottom of the base as illustrated in the drawings herein.

Figure 10A:
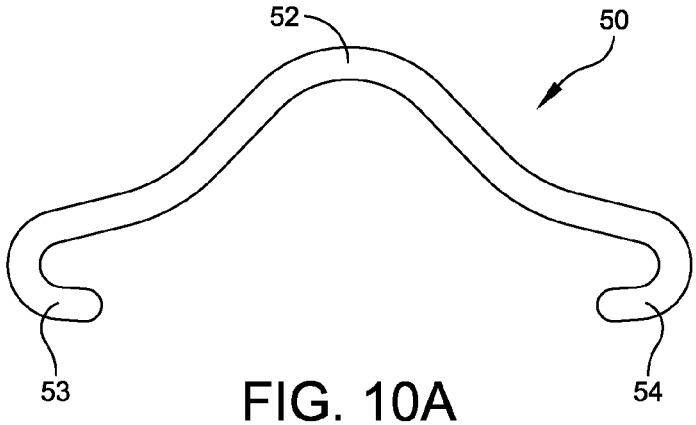
FIG. 10A is a side elevation view of one of the spacer clips.
Figure 10B:
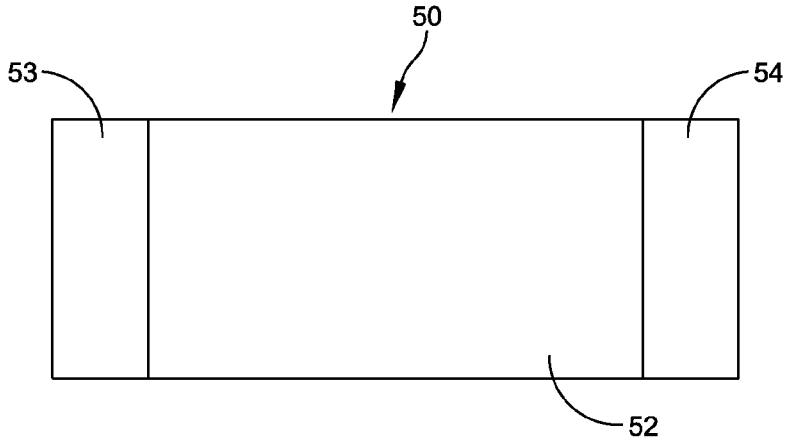
FIG. 10B is a bottom plan view of the spacer clip of FIG. 10A.

The base illustrated in FIGS. 8 and 9 is substantially identical to the base previously described in connection with FIGS. 1-6 herein. Accordingly, the description is not repeated regarding the components of the base 10. In FIGS. 9, 12A and 12B, the spacer clip 50 is illustrated in its inner base position which may be termed the active or deployed position of the spacer clip. In FIG. 12A the spacer clip 50 is illustrated in its initial unstretched position. On the other hand, in the cross-sectional view of FIG. 12B, the spacer clip 50 is illustrated in its stretched condition engaging with the respective edges 50A and 50B. FIG. 12B also illustrates the manner in which the spacer clip is disposed so as to better accommodate a smaller length roll engaged between the spacer clip 50 and an opposed section of the base. Reference is now made to FIGS. 10A and 10B for respective side and bottom views of the spacer clip 50. The spacer clip 50 is preferably constructed of a plastic material having sufficient resiliency so that the clip can be moved such as between the two alternate positions shown in FIGS. 12A and 12B. The spacer clip 50 may be considered as having a central concave area 52 with oppositely disposed legs formed as respective end loops 53 and 54. The spacer clip preferably has a somewhat curved configuration as the legs transition from the central concave area 52 to the loops 53 and 54. As illustrated in FIG. 12B, the loops at the end of the spacer clip 50 are what engages with the respective base edges 50A and 50B. These same loops are also shown engaging with the edges 50A and 50B in the stored position such as illustrated in FIG. 11B. In order to move from the rest position illustrated in FIG. 12A to the stretched or engaged position of FIG. 12B, the user may simply press against the central concave area 52 so that the spacer clip essentially expands in length until the end loops can engage with the respective base edges 50A and 50B.

As noted in, for example, FIG. 9, a pair of spacer clips 50 are employed each engaged with the respective edges of the base 10. It is preferred to have at least two spacer clips and to have the spacer clips spaced apart. However, more than two spacer clips may also be provided and the spacer clips may be disposed at different positions along the base member. Also, the spacer clips can be provided in a variety of widths depending on the length of the roll to be supported. The clips can also be of different width for a particular application.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A container for a roll of material, said container comprising:

a partially circular base and oppositely disposed end walls that are integrally formed with the base and that define with the base an open channel in which the roll of material is to be placed;

an elongated slot provided along said base and dimensioned so as to receive therethrough an end of the roll of sheet material for dispensing thereof;

an elongated elastic cord attached at opposite sides of the base and extending about the roll of material for holding the roll of material in the open channel; and at least one spacer clip selectively engageable with the base on an inner surface of the base for accommodating smaller length rolls.

2. The container of claim 1 wherein the elongated slot extends between one end wall and the opposite end wall and the spacer clip includes opposite end loops that engage respectively with an edge of the slot and a bottom edge of the base.

3. The container of claim 2 wherein the elongated slot divides the base into semi-circular first and second base segments.

4. The container of claim 3 including a first cord holder attached to the first base segment for retaining the elongated elastic cord.

5. The container of claim 4 further including a second cord holder attached to the second base segment for releasably holding the elongated elastic cord.

6. The container of claim 5 including a pair of second cord holders that are spacedly disposed.

7. The container of claim 6 wherein each second cord holder has a projection that extends radially from the second base segment, and each projection has on one side thereof a lip for receiving the elastic cord.

8. The container of claim 5 wherein the second cord holder comprises a projection that extends radially from the second base segment.

9. The container of claim 8 wherein the projection has on one side thereof a lip for receiving the elastic cord.

10. The container of claim 9 wherein the projection has on another side thereof an indentation that forms a carry handle.

11. The container of claim 4 wherein the first cord holder has a through passage for receiving ends of the elongated elastic cord so as to retain the ends in place.

12. The container of claim 1 including a pair of spacedly disposed spacer clips.

13. The container of claim 12 wherein each spacer clip is comprised of a somewhat resilient material having a central concave area and oppositely disposing legs terminating in respective loops for engaging edges that define the base.

14. The container of claim 13 wherein each of the spacer clips has a rest position and an extended position, in the extended position, the spacer clip engaging respective edges of the base.

15. The container of claim 14 wherein there are provided a pair of spacer clips spacedly disposed and engaged at opposite ends of the slot.

16. A method of supporting and dispensing sheet metal from a roll that is disposed in a container for the roll, comprising the steps of:

providing a partially circular base and oppositely disposed end walls that are integrally formed with the base and that define with the base an open channel and having an elongated slot provided along said base;

placing said roll into said base with the slot constructed and arranged so as to receive therethrough an end of the roll of sheet material for dispensing thereof;

having an elongated elastic cord attached at opposite sides of the base and extending about the roll of material for holding the roll of material in the open channel; and placing at least one spacer clip engaged with an edge of the base for accommodating smaller length rolls.

17. The method of claim 16 wherein the elongated slot divides the base into semi-circular first and second base segments, attaching the cord to a first cord holder for retaining the elongated elastic cord, and providing a pair of spacedly disposed spacer clips at opposite ends of the slot.

18. The method of claim 17 including a second cord holder attached to the second base segment for releasably holding the elongated elastic cord, and wherein each of the spacer clips has separate positions including a rest position and an extended length position wherein end loops of the spacer clip engage with respective edges of the base including an edge defining the slot.

19. The method of claim 18 wherein the second cord holder comprises a projection that extends radially from the second base segment.

20. The method of claim 19 wherein the projection has on one side thereof a lip for receiving the elastic cord.

* * * * *